US005084713A

United States Patent [19]

Wong

[11] Patent Number: 5,084,713

[45] Date of Patent: Jan. 28, 1992

[54] METHOD AND APPARATUS FOR COOLING THERMAL INK JET PRINT HEADS

[75] Inventor: Marvin G. Wong, Boise, Id.

[73] Assignee: Hewlett-Packard Company, Palo Alto, Calif.

[21] Appl. No.: 593,443

[22] Filed: Oct. 5, 1990

[51] Int. Cl.[5] ..... B41J 2/05; B41J 2/175

[52] U.S. Cl. ..... 346/1.1; 346/140 R

[58] Field of Search ..... 346/140, 1.1, 75

[56] References Cited

U.S. PATENT DOCUMENTS

| | | | |
|---|---|---|---|
| 4,500,895 | 2/1985 | Buck et al. | 346/140 |
| 4,791,440 | 12/1988 | Eldridge | 346/140 |
| 4,896,172 | 1/1990 | Nozawa | 346/140 |
| 5,019,941 | 5/1991 | Drake | 346/140 X |

*Primary Examiner*—Joseph W. Hartary

[57] ABSTRACT

A thermal ink jet cartridge which avoids problems associated with internal heat generation. The cartridge uses a resistor assembly to eject ink from the cartridge. To control heat generated by the resistors, a cooling system is provided. The cooling system consists of an ink channel positioned adjacent the resistor substrate. The channel is supplied with ink from a chamber within the cartridge. Ink flowing through the channel contacts the substrate, causing a cooling effect. The ink is then returned to the chamber in the cartridge. If desired, a pumping system for enhancing ink flow through the channel may be provided. The system may consist of a thin-film resistor positioned adjacent at least one of the openings provided between the channel and the chamber. When the resistor is energized and heated, it causes ink to flow through the openings and back into the chamber.

9 Claims, 4 Drawing Sheets

METHOD AND APPARATUS FOR COOLING THERMAL INK JET PRINT HEADS

BACKGROUND OF THE INVENTION

The present invention generally relates to thermal ink jet printing systems, and more particularly to a method and apparatus for cooling the print heads of thermal ink jet systems during operation.

The development of new and improved printing systems has created a corresponding demand for high-efficiency ink cartridges. High efficiency cartridges must be capable of delivering ink in a rapid and continuous manner with a substantial degree of print resolution. This is especially true with respect to thermal ink jet cartridges which operate at high speeds using a jetting resistor assembly. An exemplary thermal ink jet cartridge of this type is illustrated in U.S. Pat. No. 4,500,895.

Thermal ink jet systems typically use a glass or ceramic substrate having a plurality of thin-film jetting resistors attached to the substrate. Also secured to the substrate is an orifice plate made of glass, ceramic, metal, or the like having a plurality of drop expulsion holes therethrough. Each one of the drop expulsion holes is associated with at least one of the thin-film jetting resistors. When the resistors are energized, they correspondingly increase in temperature. As a result of this temperature increase, ink stored within the cartridge is thermally excited and pushed outwardly through the drop expulsion holes in the orifice plate. Thereafter, the ink is ejected from the system. This process is more completely described in the *Hewlett-Packard Journal,* May 1985, Vol. 36, No. 5.

Thermal ink jet systems of the type described above operate in an efficient manner. However, when operating at high speeds, the resistor assembly and orifice plate can become excessively hot, causing a degradation in print resolution and quality. Specifically, the increase in heat causes larger drops of ink to be expelled from the cartridge which adversely affects print resolution. The increased temperature also causes the viscosity of the ink to decrease. Again, this causes larger drops of ink to be expelled from the cartridge. In order to cool the internal components of the cartridge, one technique has involved the attachment of a metal heat sink unit (e.g. a manifold) adjacent the resistor assembly in the cartridge. However, this method has proven to be impractical from a technical and economic standpoint.

Accordingly, a need remains for a thermal ink jet system having means therein for efficiently cooling the system so that excessive heat generation and print deterioration may be prevented. The present invention satisfies this need as described below.

SUMMARY OF THE INVENTION

It is an object of the present invention to provide a thermal ink jet system of improved design and operating efficiency.

It is another object of the invention to provide a thermal ink jet system which effectively avoids problems associated with the generation of excessive heat during operation.

It is a further object of the invention to provide a thermal ink jet system having an internal subsystem designed to cool the resistor assembly in order to prevent the generation of excessive heat.

It is a still further object of the invention to provide a thermal ink jet system having cooling means therein which is capable of operating efficiently while avoiding the use of heat sink assemblies, manifolds, or the like.

In accordance with the foregoing objects, an improved thermal ink jet printing cartridge is disclosed which avoids problems associated with the internal generation of heat. As previously indicated, thermal ink jet systems use a jetting resistor assembly which thermally excites and ejects ink from the cartridge. However, in some systems, the resistor assembly can generate excessive heat, especially during sustained, high-speed operation. As a result, a deterioration in print quality and resolution occurs. To control this problem, the present invention uses an internal cooling system associated with the resistor assembly.

Thermal ink jet cartridges typically include a sealed ink storage chamber (e.g. a flexible bladder) which communicates with the rear side of the substrate on which the jetting resistors are mounted. However, the ink from the chamber normally flows through a support panel to which the rear side of the substrate is mounted. The support panel typically includes an ink flow orifice therethrough. To cool the substrate, the present invention involves a modified support panel which includes a channel in the surface of the panel. A plurality of openings are provided through the panel which enable communication between the channel and the ink storage chamber. As a result, ink within the chamber will flow through the openings and into the channel, thereby bathing the rear side of the substrate with ink. This process creates a cooling effect which controls the temperature of the substrate. In one embodiment, the flow of ink into and out of the channel is enhanced during cartridge operation by the reciprocating movement of a spherical member within the channel. In an alternative embodiment, ink flow within the channel is enhanced through the operation of a pumping resistor system associated with the channel as described herein.

These and other objects, features and advantages of the invention shall be described below in the following Brief Description of the Drawings and Detailed Description of a Preferred Embodiment.

BRIEF DESCRIPTION OF THE DRAWINGS

Illustrative and presently preferred embodiments of the invention are shown in the accompanying drawings in which.

DETAILED DESCRIPTION OF PREFERRED EMBODIMENTS

In accordance with the present invention, an improved thermal ink jet cartridge is provided which uses a jetting resistor assembly having a cooling system associated therewith. The cooling system prevents excessive heat generation during operation of the cartridge, thereby allowing a uniform degree of print quality to be maintained.

Figure 1:
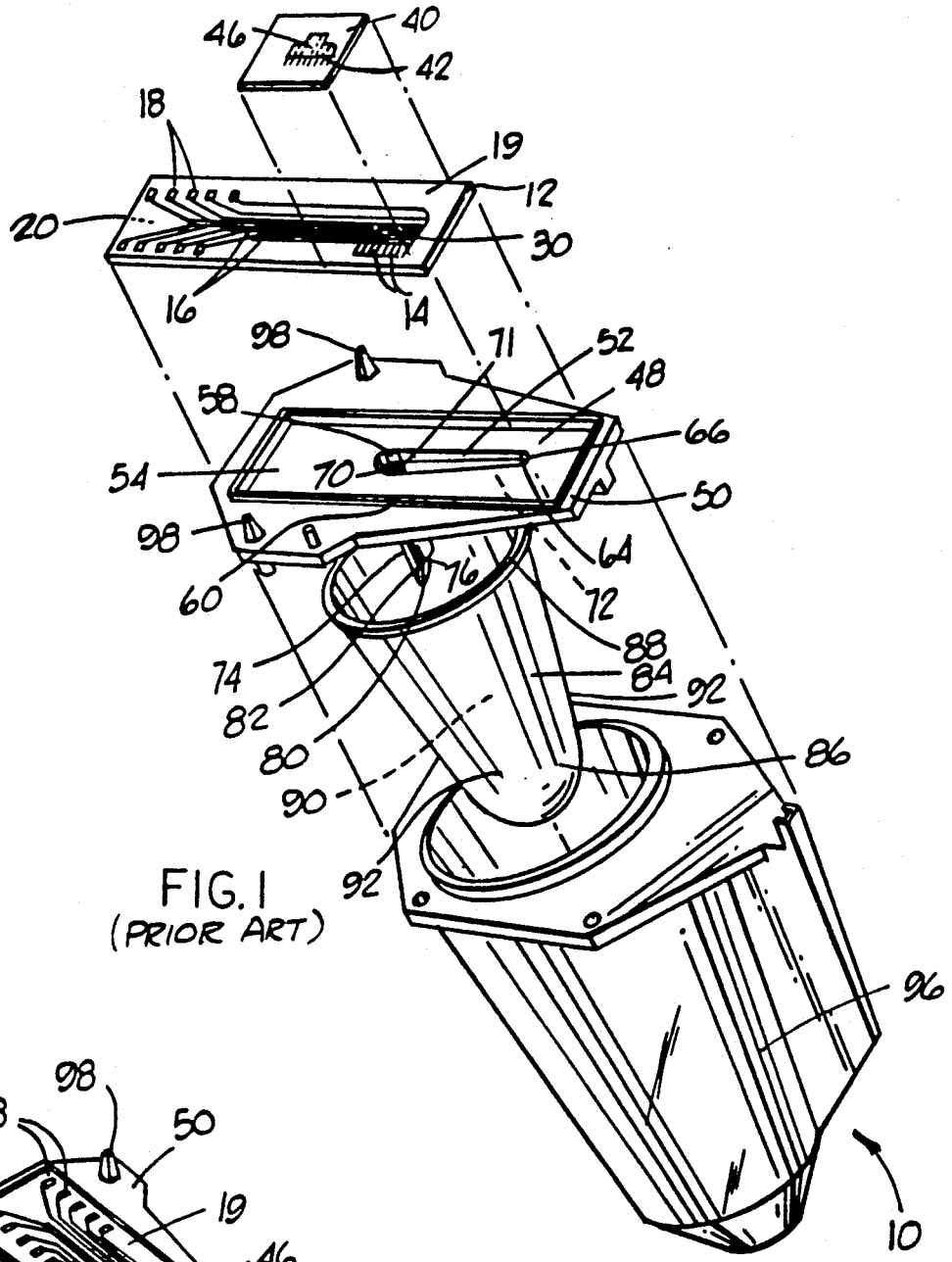
FIG. 1 (PRIOR ART)
FIG. 1 is an exploded perspective view of a representative thermal ink jet cartridge produced in accordance with the prior art.
Figure 3:
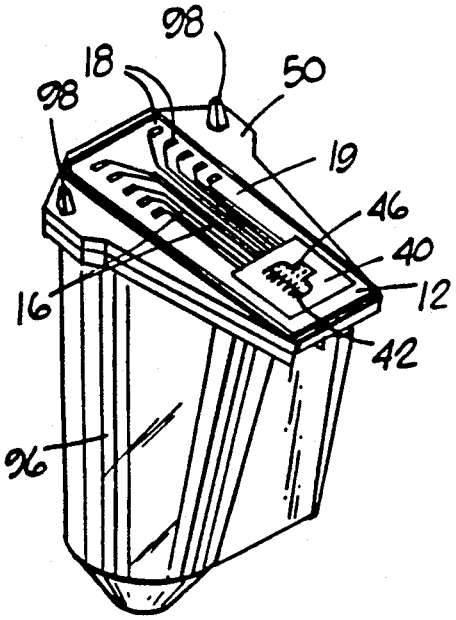
FIG. 3 (PRIOR ART)
FIG. 3 is a perspective view of the ink cartridge of FIG. 1 in an assembled condition.
Figure 2:
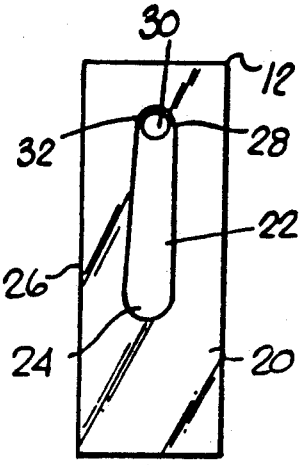
FIG. 2 (PRIOR ART)
FIG. 2 is a rear view of the substrate used in the ink cartridge of FIG. 1.

With reference to FIGS. 1-3, a representative thermal ink jet cartridge adaptable for use with the cooling system of the present invention is illustrated. This cartridge is substantially disclosed in U.S. Pat. No. 4,500,895 to Buck et.al. which is incorporated herein by reference. However, the cooling system as described below shall not be limited to incorporation within the cartridge of FIGS. 1-3, or in any other specific printing system. Instead, the cooling system may be used in other types of thermal ink jet cartridges which retain and dispense liquid ink.

With continued reference to FIG. 1, a thermal ink jet cartridge 10 is shown which includes a ceramic or glass substrate 12 having a plurality of thin-film jetting resistors 14, conductive traces 16, and conductive pads 18 on the front side 19 of the substrate 12. The rear side 20 of the substrate 12 (FIG. 2) includes an elongate groove 22 therein. The groove 22 includes a first end 24 positioned slightly below the midpoint 26 of the substrate 12. The groove 22 also includes a second end 28 which terminates in a jet feed orifice 30 at position 32 on the substrate 12. The jet feed orifice 30 passes entirely through the substrate 12, and permits the flow of ink from one side of the substrate 12 to the other side.

An orifice plate 40 is attached to the substrate 12 over the jet feed orifice 30 by adhesive, soldering, or the like. The orifice plate 40 (preferably comprised of glass, ceramic, or metal) includes a plurality of drop expulsion holes 42 (1-3 millinch in diameter), each being associated with at least one of the jetting resistors 14. The orifice plate 40 also includes a plurality of grooves 46 on the underside thereof which permit the flow of ink from the jet feed orifice 30 to the drop expulsion holes 42 by capillary action.

In the embodiment of FIGS. 1-3, the substrate 12 is mounted in a recess 48 within a substrate support panel 50. The recess 48 is slightly larger than the substrate 12 so that the substrate 12 may fit therein. Mounting of the substrate 12 within the recess 48 is accomplished using an adhesive or the like. The panel 50 is also provided with an elongate groove 52 that is positioned within the surface 54 of the recess 48 as illustrated in FIG. 1. The groove 52 does not extend entirely through the panel 50 and instead has a depth equal to about ½ of the thickness of the panel 50 in the area of the recess 48. The groove 52 has a first end 58 which is positioned slightly below the midpoint 60 of the recess 48. The groove 52 further includes a second end 64 which terminates at position 66 within the recess 48. When the substrate 12 is secured within the recess 48, the groove 52 of the panel 50 and the groove 22 of the substrate 12 are in substantial alignment. Specifically, the first end 24 of the groove 22 is aligned with the first end 58 of the groove 52. Likewise, the second end 28 (and jet feed orifice 30) of the groove 22 are aligned with the second end 64 of the groove 52.

Positioned at the first end 58 of the groove 52 is a port 70 having a filtration screen 71 mounted therein (FIG. 1). The port 70 passes entirely through the recess 48 and the panel 50. Secured in position directly over the port 70 on the rear side 72 of the panel 50 is a standpipe 74 (FIG. 1). The standpipe 74 has a passageway 76 therethrough which communicates with the port 70. In addition, the standpipe 74 terminates in an outwardly extending section 80 having arcuate side edges 82.

A flexible bladder 84 which functions as an ink storage chamber is affixed and sealed to the rear side 72 of the panel 50, preferably using an adhesive. When attached in this manner, the standpipe 74 is completely enclosed within the bladder 84. In a preferred embodiment, the bladder 84 is made of a resilient, stretchable rubber known in the art (e.g. ethylene propylene diene monomer rubber, silicone rubber, neoprene rubber, or the like). The bladder 84 is substantially tubular in configuration (e.g. circular in cross section), and includes a closed end 86 and an open end 88 which is attached to the panel 50 as noted above. Positioned between the open end 88 and the closed end 86 is a central cavity 90 designed to retain a supply of ink therein. The bladder 84 not only serves as an ink reservoir, but also provides a source of back-pressure so that the ink will only exit the drop expulsion holes 42 in the orifice plate 40 when the jetting resistors 14 are energized. This is accomplished by the maintenance of a negative pressure (e.g. a vacuum) within the bladder 84. As ink is delivered from the drop expulsion holes 42, the side walls 92 of the bladder 84 slowly collapse inwardly due to the negative pressure within the bladder 84.

A substantially rigid outer housing 96 (FIGS. 1 and 3) is provided which is adhesively affixed to the rear side 72 of the panel 50. The housing 96 provides mechanical protection for the bladder 84.

In use, the cartridge 10 is aligned in a printer (not shown) using alignment pins 98 which are provided on the panel 50 as illustrated in FIG. 1, and is held in place by a clamp (not shown) secured to either the panel 50 or the outer housing 96. The printer contains electrical contacts (not shown) which mate with the pads 18 to provide the necessary electrical signals to energize the jetting resistors 14. When the jetting resistors 14 are energized, they generate heat which thermally excites ink in the cartridge 10 that is present at or near the drop expulsion holes 42. As a result, the ink is expelled from the cartridge 10. When ink is expelled, more ink is withdrawn from the bladder 84 which passes through the standpipe 74, port 70, screen 71, and into the grooves 22, 52. Thereafter, the ink passes through jet feed orifice 30 in the substrate 12, and through the grooves 46 in the orifice plate 40 where the ink reaches the drop expulsion holes 42. Ejection of the ink then occurs as described above and in the *Hewlett-Packard Journal*, supra.

Thermal ink jet cartridges (including the cartridge described above) operate in a highly efficient manner. However, they frequently experience problems in which the jetting resistor assembly generates excessive heat as previously stated. Specifically, temperatures as high as 65° C. may be generated at the surface of the resistor substrate. This condition frequently occurs during sustained periods of high-speed operation, and may result in the deterioration of print resolution/quality. The present invention as illustrated in FIGS. 4–14 is designed to control this problem in an efficient manner.

Figure 4:
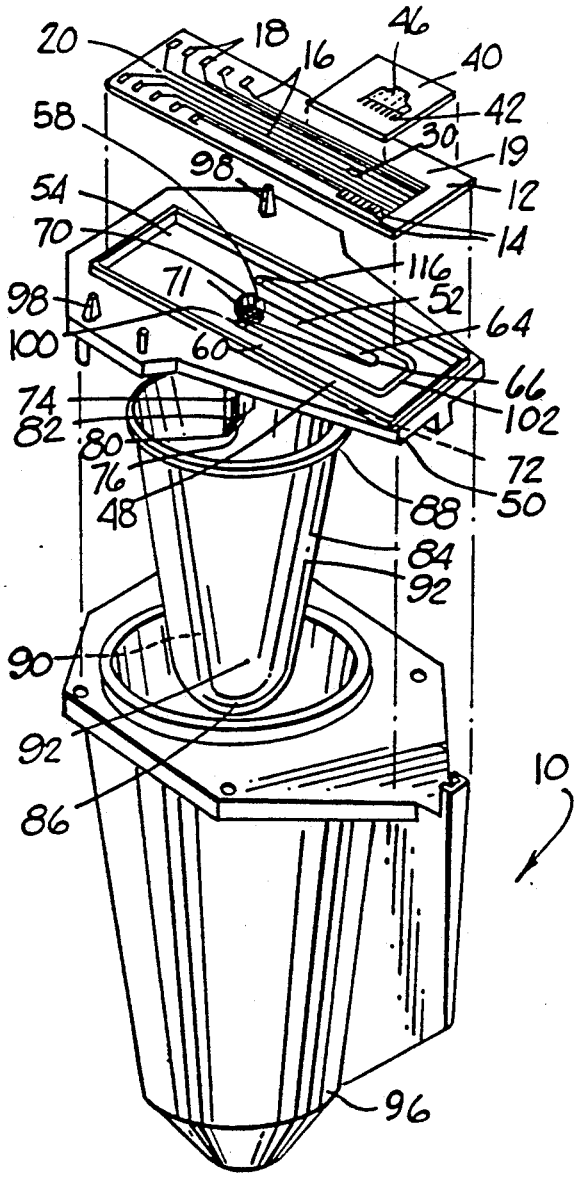
FIG. 4 is an exploded perspective view of the ink cartridge of FIG. 1 which has been modified in accordance with the present invention.

Referring now to FIG. 4, a modified ink cartridge 10 is illustrated. All of the components and operating characteristics of the cartridge 10 in FIG. 4 are identical to those of the cartridge of FIGS. 1–3 except as described below.

Figure 5:
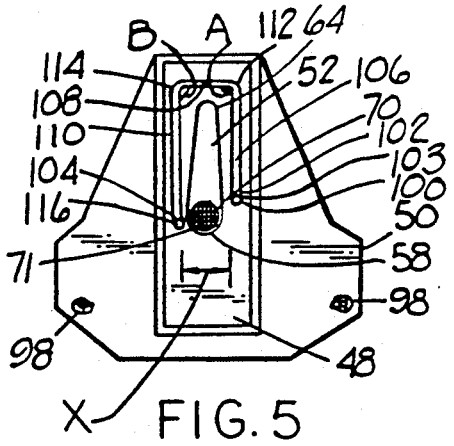
FIG. 5 is a front view of the substrate support panel used in the cartridge of FIG. 4.

With continued reference to FIG. 4, the modified cartridge 10 includes a first opening 100 is which is provided within recess 48. The first opening 100 passes entirely through the panel 50. In addition, the first opening 100 is positioned slightly above and laterally offset from the port 70 as illustrated in FIGS. 4–5. The first opening 100 is positioned so that it will communicate with the central cavity 90 of the bladder 84 as described in greater detail below.

Also provided within the surface of the recess 48 is a cooling channel 102. The cooling channel 102 has a first end 103 and a second end 104 (FIG. 5). The first end 103 is directly adjacent to and aligned with the first opening 100. The cooling channel 102 does not extend entirely through the panel 50, and instead has a preferred depth of about 0.030–0.060 inches. Preferably, the cooling channel 102 has a width of about 0.030–0.100 inches, and includes three sections 106, 108, and 110 (FIG. 5). Section 106 is spaced outwardly from and substantially parallel to the groove 52 in the recess 48, and terminates slightly above the second end 64 of the groove 52 at position 112 (FIG. 5). Beginning at position 112, section 108 is provided. In the embodiment of FIGS. 4–5, section 108 and section 106 form an angle "A" of about 90° relative to each other. Section 108 of the cooling channel 102 is spaced outwardly from the second end 64 of the groove 52, and terminates at position 114. Thereafter, section 110 is provided which terminates in a second opening 116 in the recess 48 of the panel 50. As shown in FIG. 5, the section 110 includes the second end 104 of the cooling channel 102 which is directly adjacent to and aligned with the second opening 116. In a preferred embodiment, the second opening 116 is positioned adjacent port 70, and is spaced outwardly therefrom. The section 110 is laterally spaced from the groove 52 and is substantially parallel to both the groove 52 and the section 106. Section 110 preferably forms an angle "B" of about 90° relative to the section 108. In addition, the second opening 116 extends entirely through the panel 50 and communicates with the central cavity 90 of the bladder 84.

In operation, ink from the central cavity 90 of the bladder 84 flows into and out of the cooling channel 102 through the first and second openings 100, 116. Because the cooling channel 102 is directly adjacent to and positioned against the rear side 20 of the substrate 12 in the assembled cartridge 10, ink flowing through the cooling channel 102 comes in contact with the rear side 20 of the substrate 12. As a result, the substrate 12 (which is heated by the jetting resistors 14) is substantially cooled, thereby preventing the problems associated with excess heat generation as described above. Normally, the continued flow of ink through the cooling channel 102 is enhanced by a physical process known as "thermosiphoning" in which the heated substrate 12 causes the ink to "rise" and be drawn into the cooling channel 102 from the bladder 84 through the openings 100 and/or 116. Also, in some cartridges, the reciprocating movement of the cartridge in the printer (not shown) during use facilitates ink flow through the channel 102. These combined processes enable ink to flow into and out of the first and second openings 100, 116 so that the substrate 12 may be cooled.

To effectively cool the substrate 12, the distance "X" between the sections 106 and 110 of the cooling channel 102 must be less than the width of the substrate 12. In addition, the cooling channel 102 will function optimally if the section 106 passes directly beneath the jetting resistors 14 on the substrate 12.

It should be noted that specific features of the cooling channel 102 may be suitably varied within the scope of the present invention. For example, the 90° angular relationships noted above with respect to the sections 106, 108, and 110 may be modified wherein the channel 102 forms a continuous curved section adjacent second end 64 of the groove 52. Also, one or both of the first and second openings 100, 116 could be shifted in position relative to the port 70 within the recess 48.

Figure 6:
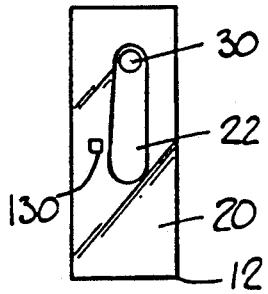
FIG. 6 is a rear view of the substrate used in an alternative embodiment of the cartridge of FIG. 4.
Figure 7:
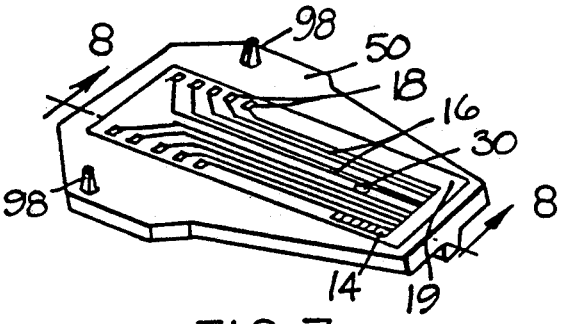
FIG. 7 is a perspective view of the substrate support panel of FIG. 5 and the substrate of FIG. 6 in an assembled condition.
Figure 8:
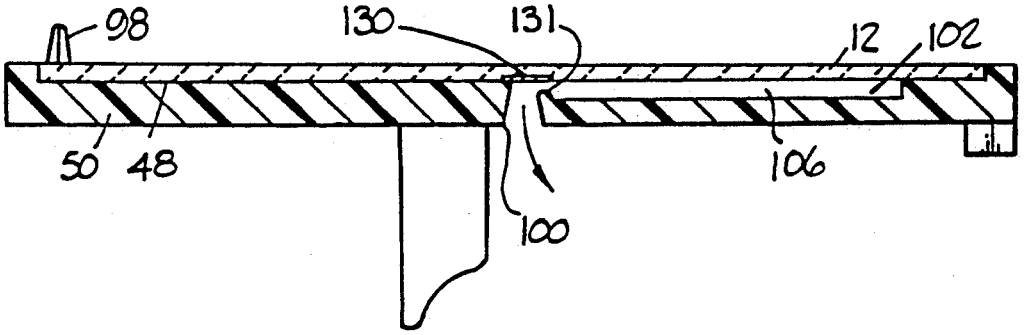
FIG. 8 is a sectional view taken along line 8—8 of FIG. 7.

In certain cases where heat generation is especially severe (e.g. during excessively sustained periods of high-speed operation), auxiliary means for circulating ink through the cooling channel 102 may be necessary or desirable. This may be accomplished through the use of a separate ink pumping means associated with the cooling channel 102 as illustrated in FIGS. 6–8. Basically, in the embodiment of FIGS. 6–8, the panel 50 and associated components (including the cooling channel 102) are the same compared with the components shown in the embodiment of FIGS. 4–5. However, the substrate 12 is different. With reference to FIG. 6, the rear side 20 of the substrate 12 includes a thin-film pump resistor 130 thereon of the same type, construction, and structure as the jetting resistors 14. The resistor 130 is positioned on the substrate 12 so that it is directly above and over at least one of the first and second openings 100, 116 through the panel 50 when the cartridge 10 is assembled. This is clearly shown in the cross-sectional view of FIG. 8, wherein the size of the resistor 130 is slightly exaggerated for illustrative purposes. In the embodiment of FIGS. 6–8, the resistor 130 is positioned on the substrate 12 so that it will be directly over the first opening 100 when the substrate 12 is secured in position within the recess 48 of the panel 50.

It should also be noted in FIG. 8 that the channel 102 includes an upwardly projecting lip 131 positioned directly adjacent opening 100. The lip 131 facilitates fluid flow through the channel 102 as described below.

The resistor 130 is designed to be selectively energized during conditions of extreme heat generation. Energization of the resistor 130 causes the resistor to act as a "pump", forcing ink within the cooling channel 102 to be expelled back into the central cavity 90 of the bladder 84. More specifically, ink which has entered the cooling channel 102 through openings 100 and/or 116 is expelled from the cooling channel 102 through the opening 100 in the embodiment of FIGS. 6–8 when the resistor 130 is activated. This is due to the heating and expulsion of the ink in a manner similar to that in which ink is ejected from the drop expulsion holes 42 during printing. In addition, the lip 131 in the channel 102 facilitates fluid flow therethrough. Specifically, if the lip 131 were not present, part of the ink within the channel 102 could impinge upon the channel floor adjacent the opening 100 and be deflected back into the channel 102 during operation of the resistor 130.

Figure 9:
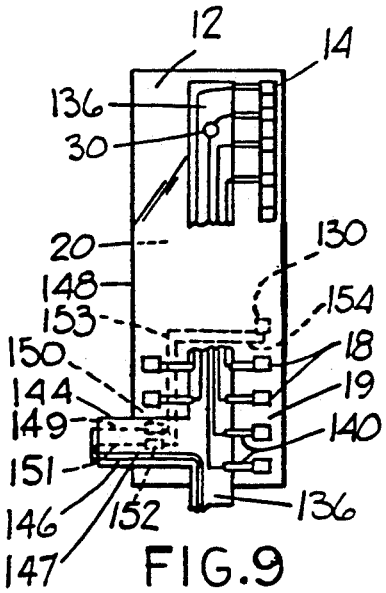
FIG. 9 is a front view of the substrate used in a further alternative embodiment of the cartridge of FIG. 4.

There are numerous ways by which the resistor 130 may be electrically connected to the conductive trace patterns on the front side 19 of the substrate 12. A representative method for accomplishing this is shown in FIG. 9. In this embodiment, the conductive trace patterns are formed through the use of a pre-fabricated TAB (Tape Automated Bonded) circuit 136 conventionally secured in position to the conductive pads 18 and jetting resistors 14 on the substrate 12. TAB circuits are known in the art, and basically consist of a flexible dielectric film having conductive traces formed thereon. The TAB circuit 136 includes a plurality of beam-type leads 140 which secure the circuit 136 to the pads 18 and resistors 14 as shown. However, the TAB circuit 136 of the embodiment of FIG. 9 includes an additional film portion 144 having a conductive traces 146, 147 thereon. The film portion 144 extends from the front side 19 of the substrate 12 around edge 148 to the rear side 20 thereof. The lead 149 of the trace 146 is then conventionally attached to a conductive interconnection pad 150 on the rear side 20 of the substrate 12 as shown in FIG. 9. Likewise, the lead 151 of the trace 147 is conventionally attached to a conductive interconnection pad 152 on the rear side 20 of the substrate 12. The resistor 130 may then be connected to the pads 150, 152 using conductive traces 153, 154 on the rear side 20 of the substrate 12. There are other possible methods which may be used to electrically connect the resistor 130 to the conductive trace patterns on the front side 19 of the substrate 12, and the present invention shall not be limited to any specific method.

Figure 10:
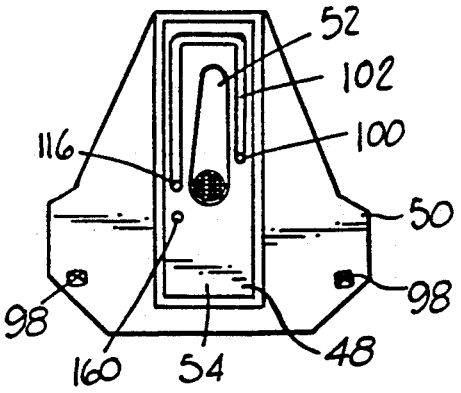
FIG. 10 is a front view of the substrate support panel used in a still further alternative embodiment of the cartridge of FIG. 4.
Figure 11:
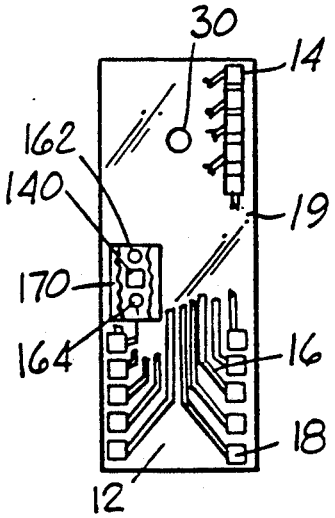
FIG. 11 is a front view of the substrate used in connection with the substrate support panel of FIG. 10.
Figure 12:
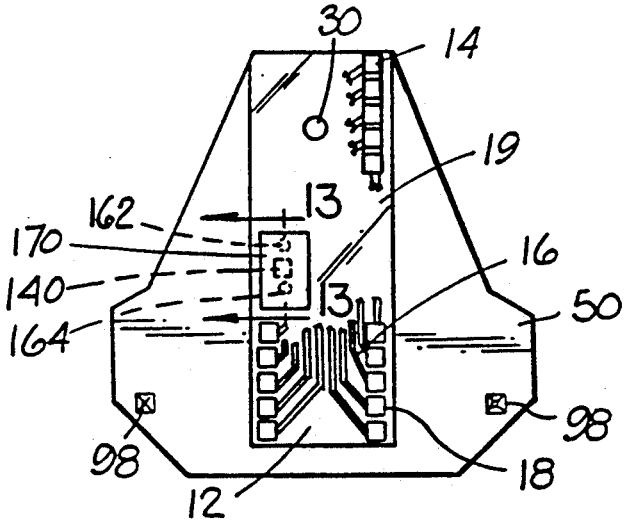
FIG. 12 is a front view of the substrate support panel and the substrate of FIGS. 10 and 11 in an assembled condition.
Figure 13:
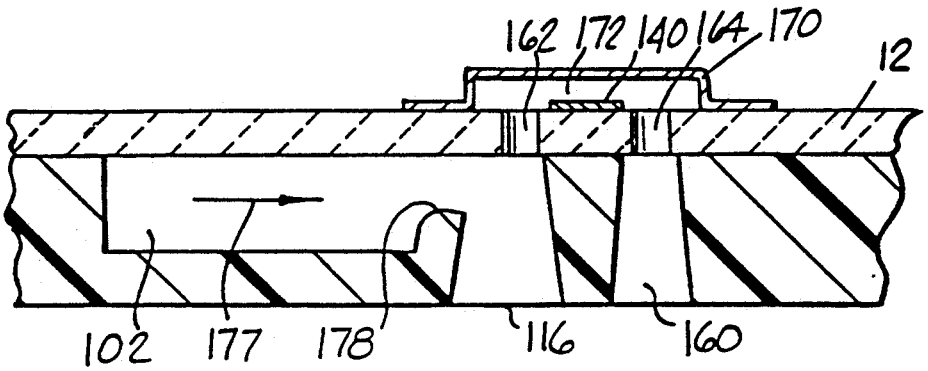
FIG. 13 is a sectional view taken along line 13—13 of FIG. 12.

Another embodiment of a pumping means applicable in the present invention is illustrated in FIGS. 10–13. In this embodiment, a resistor 140 is positioned on the front side 19 of the substrate 12 as shown in FIG. 11. The cooling channel 102 is the same as in the previous embodiments. However, the panel 50 includes a third opening 160 within the recess 48 which is directly below the second opening 116 as illustrated in FIG. 10. The third opening 160 communicates with the central cavity 90 of the bladder 84. In addition, first and second bores 162, 164 are provided through the substrate 12 above and below the resistor 140 as shown in FIG. 11. Secured in position over the resistor 140 and bores 162, 164 is a manifold 170 (FIGS. 11–13), preferably manufactured of metal or the like. Portions of the manifold 170 are broken away in FIG. 11 to illustrate the resistor 140 and bores 162, 164 thereunder. Affixation of the manifold 170 in position may be accomplished using an adhesive known in the art or the like. In addition, the manifold 170 may be manufactured as part of the orifice plate 40, or may consist of a separate unit as shown in FIGS. 11–13.

The manifold 170 is designed to completely cover the resistor 140 and the bores 162, 164 as illustrated in the cross sectional view shown in FIG. 13. Specifically, the manifold 170 is configured so that an open zone 172 is provided between the manifold 170 and the surface of the substrate 12 as illustrated in FIG. 13.

In operation, ink from the central cavity 90 of the bladder 84 flows into the openings 100, 116 by thermosiphoning or the like, and through the cooling channel 102. A substantial amount of the ink flows in the direction of arrow 177 over a lip 178 adjacent second opening 116 partially due to the reciprocating action of the cartridge 10 in the printer. Thereafter, the ink flows into the second opening 116, and into the bore 162 which is aligned therewith. After passing through the bore 162, the ink enters open zone 172, coming into contact with the resistor 140. Selective energization and heating of the resistor 140 causes ink in the open zone 172 to be expelled outwardly through the bores 162, 164 which are aligned with the second and third openings 116, 160, respectively. Ink expulsion occurs in the same manner as described above with respect to resistor 130. Thereafter, the ink flows through the openings 116, 160 and back into the central cavity 90 of the bladder 84. In this manner, a continuous flow of ink through the cooling channel 102 is accomplished, thereby cooling the substrate 12 in a rapid and efficient manner. It should be noted that the lip 178 in the channel 102 adjacent the second opening 116 increases the flow rate of the ink back into the bladder 84. When the resistor 140 causes ink to be ejected through the second opening 116, this process creates a fluid pressure differential which correspondingly pulls ink toward the second opening 116 from the cooling channel 102. Also, if the lip 178 were not there, part of the ink could impinge on the floor of channel 102 adjacent the opening 116 and be deflected back into the channel 102. In addition, it should be noted that the second and third openings 116, 160 gradually increase in diameter in the direction of bladder 84. This design facilitates fluid flow through the openings 116, 160 since the increasing diameter thereof provides decreased flow resistance compared with openings of uniform diameter. It is preferred that the configuration of openings 116, 160 also be applied to the first opening 100 as illustrated in FIG. 8. Finally, it should be noted that the resistor 140 and third opening 160 may be placed adjacent first opening 100 instead of being adjacent second opening 116. In either version, the same results are achieved.

Figure 14:
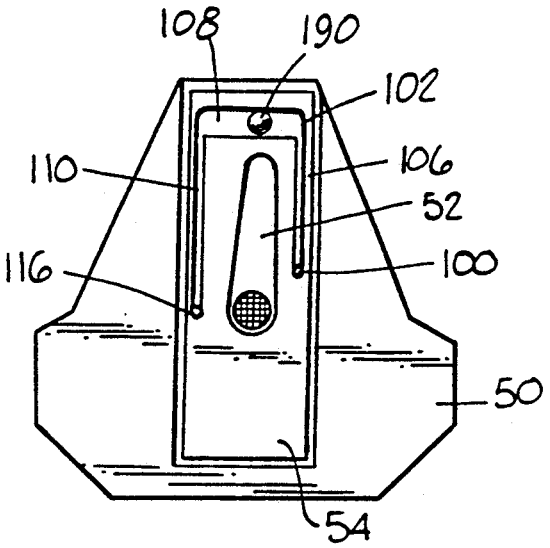
FIG. 14 is a front view of the substrate support panel used in an even further embodiment of the cartridge of FIG. 4.

A final embodiment of the present invention is illustrated in FIG. 14. This embodiment is particularly designed for use in connection with the cartridge of FIGS. 4–5. Specifically, in some cartridges, the combined effects of thermosiphoning/reciprocating motion are insufficient to enable ink to properly flow through the channel 102. In the embodiment of FIG. 14, the configuration of the channel 102 is modified, with the other components remaining the same as those shown in FIGS. 4–5. With reference to FIG. 14, the sections 106, 110 of the channel 102 have a width and depth which are the same as that described above (e.g. width=0.030–0.100 in. and depth=0.030–0.060 in.) However, in the embodiment of FIG. 14, the width of section 108 is different. Specifically, the width will be approximately 3–4 times greater than that of the sections 106, 110. The increased width is designed to accommodate a freefloating spherical member 190 therein. An exemplary spherical member consists of a teflon-coated lead ball, although other suitable materials known in the art may be used. The diameter of the spherical member 190 is not critical, but should be less than the width of section 108 and greater than the width of the sections 106, 110. In addition, the diameter of the spherical member 190 should be less than the depth of the sections 106, 108, 110. Accordingly, this will enable the spherical member 190 to move freely within the section 108, while preventing the movement thereof into sections 106, 110. To further accommodate movement of the spherical member 190 within section 108, the bottom surface of the section 108 may be formed in an arcuate configuration (not shown). In operation, the reciprocating movement of the cartridge within the printer will cause the spherical member 190 to act as a piston, pushing ink alternately into sections 106, 110 and through openings 100, 116, respectively. In this manner, ink circulation through the channel 102 is enhanced.

The present invention enables the efficient and rapid cooling of resistor substrates in thermal ink jet cartridges. Furthermore, cooling is accomplished using a minimal number of operating components. Thus, the invention represents a distinct advance in the art of thermal ink jet technology. Having herein described a preferred embodiment of the present invention, it is anticipated that suitable modifications may be made thereto by individuals skilled in the art within the scope of the invention. For example, if it is desired that pumping means be used to enhance cooling, a wide variety of systems may be applicable which are equivalent to those described herein. Furthermore, the configuration of the cooling channel may be varied, as well as the position of the openings through the substrate support panel. Thus, the scope of the invention shall only be construed in accordance with the following claims:

I claim:

1. A method for cooling the substrate of a thermal ink jet printing apparatus in which said substrate comprises a front side and a rear side with a plurality of resistors on said front side, and said apparatus comprises an ink storage chamber in fluid communication with said resistors so that ink within said chamber may be supplied to said resistors comprising the steps of:

providing a support panel adapted for placement between said rear side of said substrate and said chamber, said support panel having a front side and a rear side;

placing a channel within the surface of said front side of said support panel;

forming a plurality of openings through said support panel in fluid communication with said channel;

securing a pump resistor to said substrate, said pump resistor being secured to said substrate at a position thereon so that said pump resistor is in fluid communication with at least one of said openings through said support panel when said substrate is secured to said support panel;

securing said rear side of said substrate to said front side of said support panel;

securing said ink storage chamber to said rear side of said support panel allowing ink to flow into and out of said channel through said openings, said ink coming in contact with said rear side of said substrate in order to cool said substrate; and energizing said pump resistor in order cause the generation of heat therefrom, said heat causing ink coming in contact with said pump resistor to flow outwardly through said one of said openings and into said ink storage chamber.

2. The method of claim 1 wherein said pump resistor is secured to said rear side of said substrate.

3. A thermal ink jet printing apparatus comprising:

a substrate having a front side, a rear side, and at least one ink feed orifice therethrough;

a plurality of resistors secured to said front side of said substrate for heating ink which passes through said ink feed orifice in order to expel said ink from said apparatus;

a support panel having a front side, a rear side, and a port therethrough in fluid communication with said ink feed orifice, said rear side of said substrate being secured to said front side of said support panel;

an ink storage chamber operatively attached to said rear side of said support panel for storing ink therein, said ink being delivered from said chamber to said resistors through said port in said support panel and said ink feed orifice through said substrate; and cooling means within said support panel for directing a flow of ink from said chamber along said rear side of said substrate and back into said chamber in order to cool said substrate during the operation of said apparatus, said cooling means comprising:

a first opening through said support panel;

a second opening through said support panel, said first and second openings being in fluid communication with said ink storage chamber;

an ink flow channel positioned within the surface of said front side of said support panel having a first end and a second end, said first end being in fluid communication with said first opening, and said second end being in fluid communication with said second opening, said ink from said chamber flowing into and out of said channel through said first opening and said second opening, said ink within said channel coming in contact with said rear side of said substrate for the cooling thereof; and at least one pump resistor positioned adjacent to and in fluid communication with at least one of said first opening and said second opening, the activation of said pump resistor causing ink coming in contact with said pump resistor to be directed from said channel back into said ink storage chamber.

4. The apparatus of claim 1 wherein said first opening and said second opening are on opposite sides of said port through said support panel.

5. The apparatus of claim 1 wherein at least one portion of said channel within said support panel passes directly beneath said resistors on said substrate.

6. The apparatus of claim 1 wherein said pump resistor is secured to said rear side of said substrate at a position thereon wherein said pump resistor is directly above and in alignment with said one of said first opening and said second opening.

7. A thermal ink jet printing apparatus comprising:

a substrate having a front side, a rear side, and at least one ink feed orifice therethrough;

a plurality of resistors secured to said front side of said substrate for heating ink which passes through said ink feed orifice in order to expel said ink from said apparatus;

a support panel having a front side, a rear side, and a port therethrough in fluid communication with said ink feed orifice, said rear side of said substrate being secured to said front side of said support panel;

an ink storage chamber operatively attached to said rear side of said support panel for storing ink therein, said ink being delivered from said chamber to said resistors through said port in said support panel and said ink feed orifice through said substrate; and cooling means within said support panel for directing a flow of ink from said chamber along said rear side of said substrate and back into said chamber in order to cool said substrate during the operation of said apparatus, said cooling means comprising:

a first opening through said support panel;

a second opening through said support panel, said first and second openings being in fluid communication with said ink storage chamber;

an ink flow channel positioned within the surface of said front side of said support panel having a first end and a second end, said first end being in fluid communication with said first opening, and said second end being in fluid communication with said second opening, said ink from said chamber flowing into and out of said channel through said first opening and said second opening, said ink within said channel coming in contact with said rear side of said substrate for the cooling thereof, said channel further comprising a first section, a second section, and a third section, said second section being positioned between said first and third sections, the width of said first and third sections being less than the width of said second section; and a spherical member positioned within said second section of said channel, said spherical member having a diameter less than the width of said second section and greater than the width of said first and third sections in order to allow said spherical member to freely move within said second section, while preventing the movement thereof into said first and third sections.

8. A thermal ink jet printing apparatus comprising:

a substrate having a front side, a rear side, a first bore therethrough, a second bore therethrough, and at least one ink feed orifice therethrough;

a plurality of resistors secured to said front side of said substrate for heating ink which passes through said ink feed orifice in order to expel said ink from said apparatus;

a support panel having a front side, a rear side, and a port therethrough in fluid communication with said ink feed orifice, said rear side of said substrate being secured to said front side of said support panel;

an ink storage chamber operatively attached to said rear side of said support panel for storing ink therein, said ink being delivered from said chamber to said resistors through said port in said support panel and said ink feed orifice through said substrate; and cooling means within said support panel for directing a flow of ink from said chamber along said rear side of said substrate and back into said chamber in order to cool said substrate during the operation of said apparatus, said cooling means comprising:

a first opening through said support panel;

a second opening through said support panel, said first and second openings being in fluid communication with said ink storage chamber;

a third opening through said support panel positioned adjacent at least one of said first opening and said second opening, said first bore through said substrate being directly above and in alignment with said one of said first opening and said second opening, and said second bore of said substrate being directly above and in alignment with said third opening;

an ink flow channel positioned within the surface of said front side of said support panel having a first end and a second end, said first end being in fluid communication with said first opening, and said second end being in fluid communication with said second opening, said ink from said chamber flowing into and out of said channel through said first opening and said second opening, said ink within said channel coming in contact with said rear side of said substrate for the cooling thereof; and at least one pump resistor secure to said front side of said substrate between said first bore and said second bore, said first bore, said second bore, and said pump resistor being covered by a manifold member secured to said front side of said substrate, said manifold member being spaced outwardly from said pump resistor in order to form an open zone therebetween.

9. A thermal ink jet printing apparatus comprising:

a substrate having a front side, a rear side, and at least one ink feed orifice therethrough;

a plurality of resistors secured to said front side of said substrate for heating ink which passes through said ink feed orifice in order to expel said ink from said apparatus;

a support panel having a front side, a rear side, and a port therethrough in fluid communication with said ink feed orifice, said rear side of said substrate being secured to said front side of said support panel;

an ink storage chamber operatively attached to said rear side of said support panel for storing ink therein, said ink being delivered from said chamber to said resistors through said port in said support panel and said ink feed orifice through said substrate; and cooling means within said support panel for directing a flow of ink along said rear side of said substrate comprising a plurality of openings through said support panel in fluid communication with said ink storage chamber, an ink flow channel positioned within the surface of said front side of said support panel, said channel being in fluid communication with said openings so that ink from said chamber may flow into and out of said channel through said openings, and at least one pump resistor positioned adjacent to and in fluid communication with said channel, the activation of said pump resistor causing ink coming in contact with said pump resistor to be directed from said channel through at least one of said openings back into said ink storage chamber.

* * * * *